United States Patent [19]

Culling

[11] 3,947,266

[45] Mar. 30, 1976

[54] CORROSION-RESISTANT ALLOYS

[75] Inventor: John H. Culling, Kirkwood, Mo.

[73] Assignee: Carondelet Foundry Company, St. Louis, Mo.

[22] Filed: May 17, 1974

[21] Appl. No.: 470,795

[52] U.S. Cl. ..... 75/122; 75/134 F

[51] Int. Cl.[2] ..... C22C 30/00

[58] Field of Search ..... 75/134 F, 122

[56] References Cited

UNITED STATES PATENTS

| | | | |
|---|---|---|---|
| 3,044,871 | 7/1962 | Mott | 75/125 |
| 3,552,950 | 1/1971 | Rundell et al. | 75/122 |
| 3,582,318 | 6/1971 | Szumachowski | 75/122 |
| 3,758,294 | 9/1973 | Bellot et al. | 75/122 |
| 3,758,296 | 9/1973 | Johnson | 75/122 |
| 3,759,704 | 9/1973 | Culling | 75/122 |
| 3,813,239 | 5/1974 | Flint et al. | 75/122 |
| 3,844,774 | 10/1974 | Culling | 75/134 F |

*Primary Examiner*—L. Dewayne Rutledge
*Assistant Examiner*—E. L. Weise
*Attorney, Agent, or Firm*—Koenig, Senniger, Powers and Leavitt

[57] ABSTRACT

An air-meltable, castable, workable alloy resistant to corrosion in sulfuric acid over a wide range of acid strengths. The alloy consists essentially of between about 28.59 and about 36.72% by weight nickel, between about 26.33 and about 30.15% by weight chromium, between about 3 and about 4.1% by weight molybdenum, between about 3 and about 4.5% by weight copper, between about 3 and about 4% by weight manganese, up to about 0.5% by weight cobalt, up to about 0.60% by weight silicon, up to about 0.07% by weight carbon, up to about 1% by weight tantalum, up to about 1% by weight titanium, up to about 2.38% by weight niobium, up to about 0.010% by weight boron, up to about 0.6% by weight of a rare earth component selected from the group consisting of cerium, lanthanum and misch metal, up to about 0.15% by weight nitrogen, and the balance essentially iron. The sum of the chromium content and 0.56 times the niobium content is between about 27 and about 31% by weight. The nickel content exceeds the chromium content by at least about 1.5% and also exceeds the sum of the chromium content and 0.56 times the niobium content by at least about 1.4%. Where the carbon content exceeds 0.04% by weight, it must be less than the sum of five times the titanium content and 10 times the niobium plus tantalum content.

5 Claims, No Drawings

CORROSION-RESISTANT ALLOYS

BACKGROUND OF THE INVENTION

This invention relates to the field of corrosion-resistant alloys and more particularly to low strategic metal content workable alloys resistant to both oxidizing and reducing sulfuric acid solutions over a wide range of acid concentrations.

For purposes of analyzing and predicting their corrosive effect on various metals, acids and other corrosive agents are commonly classified as either "oxidizing" or "reducing". A reducing medium is one in which the strongest oxidizing agent is the hydrogen ion or hydronium ion while an oxidizing medium includes components which are more highly oxidizing than either the hydrogen ion or hydronium ion. Sulfuric acid is normally a reducing acid but high strength sulfuric acid is often oxidizing, especially at elevated temperatures. Moreover, various industrial sulfuric acid streams contain various oxidizing acids and salts as contaminants. It is, therefore, desirable that an alloy designed for general utility in industrial sulfuric acid streams be resistant to both reducing and oxidizing environments.

Corrosion resistance of any given metal or alloy in a reducing medium is often sharply different from its resistance in an oxidizing medium with some metals and alloys being more resistant to reducing media and others to oxidizing media. These differences in behavior are thought to be attributable to differences between the corrosion mechanism in a reducing medium and the corrosion mechanism in an oxidizing medium. Thus, corrosive attack by a reducing acid is generally considered to involve attack on the metal by hydrogen ions resulting in the oxidation of metal to soluble ions and release of hydrogen gas. Metals of relatively high nobility, therefore, as indicated by their positions in the galvanic series, are generally resistant to corrosion by reducing acids. Attack by oxidizing media on the other hand does not involve release of hydrogen but commonly results in the formation of metal oxides or other metallic compounds at the metal surface. Unlike the situation with reducing acids, a favorable position relative to hydrogen in the electromotive series provides no insurance that a metal will not be rapidly attacked by an oxidizing medium. However, certain elements such as chromium, aluminum and silicon form tough insoluble oxide films on initial contact with an oxidizing medium and such films serve as barriers against further reaction between the medium and the metal, thus preventing further corrosion from taking place.

Sulfuric acid solutions are not only very corrosive generally but the nature of their corrosion properties varies markedly with both acid concentration and temperature. This variability relates at least in part to sulfuric acid's ambivalent assumption of both reducing and oxidizing properties as its concentration, temperature, and the nature and proportions of various contaminants are altered. As a consequence of this variability in its corrosive properties, few materials are available which are reasonably resistant to sulfuric acid solutions over a wide range of concentrations and temperatures. A relatively large number of available materials exhibit reasonable resistance to either dilute sulfuric acid solutions having an acid strength of less than about 20% by weight or to concentrated solutions having an acid strength greater than 80% by weight. A lesser number of materials are effective for the intermediate and generally more corrosive concentration range of 20–80%, and even fewer metals are commercially useful in contact with sulfuric acid solutions ranging from strengths below 20 to greater than 80%, particularly when exposed to elevated temperatures.

Of the known alloys which are demonstrably effective over wide ranges of sulfuric acid concentrations, many contain relatively high portions of nickel and chromium and are thus rather expensive. In my copending and coassigned U.S. patent application Ser. No. 463,886, filed Apr. 25, 1974, filed as a continuation-in-part of U.S. patent application Ser. No. 346,693, filed Mar. 30, 1973, which was in turn filed as a continuation-in-part of U.S. patent application Ser. No. 137,641, filed Apr. 26, 1971, sulfuric acid corrosion-resistant alloys are described in which the nickel content ranges between 22.1 and 52.1% by weight and the chromium content is quite low, ranging between 4 and 14.18% by weight. These are very desirable alloys, but have a fairly appreciable molybdenum content in the range of 4.77–17.9%. Another highly desirable alloy I have discovered is that described in my copending and coassigned U.S. patent application Ser. No. 399,687, filed Sept. 24, 1973. This alloy also has an appreciable molybdenum content, however, in the range of 6.7–14.5%. Molybdenum is a fairly scarce and expensive metal whose presence in significant quantities materially contributes to the overall cost of the alloy.

Johnson U.S. Pat. No. 3,758,296 discloses a relatively low molybdenum content alloy comprising 26–48% nickel, 30–34% chromium, 4–5025% molybdenum, 4–7.5% cobalt, 3–25% iron, 2.5–8% copper, 0.05–0.25% carbon, up to 4% silicon and up to 0.10% boron. Silicon in the range of 2–3.5% is said to be preferred. The alloys disclosed by Johnson, however, exhibit rather high hardness, not only because of the preferred 2–3.5% silicon content, but also because of the required presence of 4–7.5% cobalt. The alloys of the Johnson patent are designed to be susceptible to precipitation hardening, a two-step process in which the alloy is first subjected to solution heat treatment followed by rapid quenching, and then to a precipitation or aging treatment which causes separation of a second phase from the solid solution, attended by hardening of the alloy. Because of the relatively high hardness and high yield strength which they exhibit, the alloys of the Johnson patent are primarily adpated for use in castings and are not readily susceptible to working into wrought forms.

A continuing need has, therefore, existed for corrosion-resistant workable alloys having a relatively low strategic metal content. In particular, a need has existed for such alloys in which the nickel and chromium contant is relatively low, since nickel and chromium are both expensive metals supplied almost exclusively from sources outside the United States. At the same time, there has been a need for such alloys which are not only low in nickel and chromium but also have the lowest feasible proportions of other expensive components such as molybdenum, tantalum, tungsten, vanadium and niobium.

SUMMARY OF THE INVENTION

Among the several objects of the present invention, therefore, may be noted the provision of improved alloys resistant to both oxidizing and reducing sulfuric acid solutions; the provision of such alloys which are resistant to sulfuric acid over a wide range of concentrations and temperatures; the provision of such alloys which are resistant to sulfuric acid containing oxidizing contaminants such as nitric acid; the provision of such alloys which can be cast or wrought; the provision of such alloys which have a low hardness and high ductility so that they may be readily rolled, forged, welded and machined; and the provision of such alloys which may be economically formulated with relatively low proportions of strategic metals such as nickel and chromium. Other objects and features will be in part apparent and in part pointed out hereinafter.

Briefly, therefore, the present invention is directed to an air-meltable, castable, workable alloy resistant to corrosion in sulfuric acid over a wide range of acid strengths. The alloys of the invention consists essentially of between about 28.59 and 36.72% by weight nickel, between about 26.33 and about 30.15% by weight chromium, between about 3 and about 4.1% by weight molybdenum, between about 3 and about 4.5% by weight copper, between about 3 and about 4% by weight manganese, up to about 0.5% by weight cobalt, up to about 0.60% by weight silicon, up to about 0.07% by weight carbon, up to about 1% by weight tantalum, up to about 1% by weight titanium, up to about 2.38% by weight niobium, up to about 0.010% by weight boron, up to about 0.60% by weight of a rare earth component selected from the group consisting of cerium, lanthanum and misch metal, up to about 0.15% by weight nitrogen, and the balance essentially iron. The sum of the chromium content and 0.56 times the niobium content is between about 27 and about 31% by weight. The nickel content exceeds the chromium content by at least about 1.5% by weight and also exceeds the sum of the chromium content and 0.56 times the niobium content by at least about 1.4% by weight. Where the carbon content exceeds 0.04% by weight, it must be less than the sum of five times the titanium content and 10 times the niobium plus tantalum content.

DESCRIPTION OF THE PREFERRED EMBODIMENTS

The alloys of the invention include relatively low proportions of strategic metals, yet are highly resistant to corrosion by sulfuric acid over a wide range of concentrations, both in the reducing and in the oxidizing ranges. The alloys retain their corrosion resistance even at elevated temperatures and show effective corrosion resistance in the presence of sulfuric acid concentrations of 20–80%, an environment in which rapid failure is frequently experienced in alloys specifically designed for use in either dilute or concentrated acid. This strong resistance to corrosion is retained, moreover, even when the sulfuric acid solution contains oxidizing agents, such as nitric acid.

The excellent corrosion resistance of the alloys of the invention is in part attributable to the fact that they are single-phase solid solutions having an austenitic (face-centered cubic) structure. Attainment of this structure does not require heat treatment but is realized in the as-cast condition of the alloy. These alloys not only possess low hardness characteristics as-cast but also remain unaffected by precipitation hardening techniques. Even if the alloy is heat treated under conventional age hardening conditions, no precipitation, phase changes or significant changes in hardness are observed.

The alloys of the invention may be either cast or wrought. Because of their very low hardness on the order of 108–131 BHN, relatively low yield strength, and correspondingly high ductility, they may be readily rolled, forged, welded or machined. As a consequence, these alloys are highly adapted for use in fabrication of pipe and process equipment for utilization in the chemical or other process industries.

The essential components of the alloys of the invention are:

| | |
|---|---|
| Nickel | 28.59–36.72% |
| Chromium | 26.33–30.15% |
| Molybdenum | 3–4.1% |
| Copper | 3–4.5% |
| Manganese | 3–4% |
| Iron | to make 100% |

It is well recognized that the presence of chromium in iron-based alloys affords resistance to oxidizing media, due to rapid initial oxidation of chromium to form a thin film which passivates the alloy against further attack. In accordance with the present invention, it has been discovered that a minimum chromium content on the order of 27% by weight provides an especially strong passivating effect in an iron/nickel/chromium type alloy. Niobium acts similarly to chromium in passivating such alloys and thus may be substituted in part for chromium. In the presence of niobium, therefore, the chromium content can be as low as about 26.33% provided that the sum of the chromium content and 0.56 times the niobium content is between about 27 and about 31% by weight. Because of its higher atomic weight, 1% by weight niobium is equivalent only to about 0.56% by weight chromium in its contribution to oxidation resistance of the alloy. Although niobium may thus be advantageously included in the alloy and serves to substitute in part for chromium, it is nonetheless preferred that the chromium content be 27% or more, even when niobium is present. Exceptionally good corrosion resistance is realized when the chromium content is equal to or greater than 27%.

It has further been found essential that the nickel content of the alloy exceed the chromium content by at least about 1.5% and also exceed the sum of the chromium content and 0.56 times the niobium content by at least 1.4% by weight. Preferably, the nickel content exceeds the sum of chromium and 0.56 times niobium by about 4% and, in an especially preferred embodiment of the alloy, the sum of chromium and 0.56 times niobium is between about 27 and 28% by weight and the nickel content is between about 31 and about 32% by weight nickel.

Manganese is an important component of the alloys of the invention since its presence in the range of 3–4% by weight allows an austenitic structure to be maintained even with the relatively low nickel to chromium ratio of these alloys. For an alloy having the nickel and chromium contents specified herein, the influence of manganese in promoting austenitic structure passes through an optimum in the 3–4% range. Significantly higher proportions may be detrimental, therefore, or at least may necessitate higher proportions of nickel to maintain a face centered cubic structure.

Manganese in the defined range is not only useful as an austenitizer but also promotes rapid initial oxidation of chromium to provide the passivating layer which affords a high level of resistance to oxidizing media. It has been discovered, for example, that 3–4% manganese provides markedly improved corrosion resistance in 80–93% $H_2SO_4$ at 80° C. Additionally, manganese is a deoxidizing element whose presence helps insure the provision of gas-free sound metal ingots.

Copper is an essential component whose presence to the extent of at least about 3% by weight contributes materially to the corrosion resistance of the alloys of the invention. It is essential, however, that the copper content not exceed approximately 4.5% and, preferably, the copper content should not be higher than about 4% by weight. If the proportion of copper is significantly higher than 4.5% by weight, it may exceed its solubility limits in the alloy resulting in the solid state formation of copper rich precipitates that have a detrimental effect on the alloy's corrosion resistance. Presence of a copper rich secondary phase is also detrimental to fabricability since it may cause splitting or cracking during hot rolling, cold rolling or forging.

The proportions which have been specified for nickel, chromium, manganese, and copper allow the molybdenum content of the alloy to be maintained at the relatively low level of 3–4.1% by weight. Maintaining a low proportion of molybdenum is not only economically advantageous but avoids problems which can be experienced with higher proportions of melybdenum. Thus, a molybdenum content significantly higher than 4.1% may be detrimental to the corrosion resistance of a nickel/chromium/iron alloy under highly oxidizing conditions and molybdenum is also known to be a solid solution hardener which can adversely affect mechanical properties of the alloy, making it less readily susceptible to machining, rolling, and forging.

As noted, niobium may be partially substituted for chromium in the alloys of the invention. The range of proportions for niobium and other optional components of these alloys are set forth in the table below:

| | |
|---|---|
| Cobalt | up to 0.5% by weight |
| Silicon | up to 0.60% by weight |
| Carbon | up to 0.07% |
| Tantalum | up to 1% |
| Titanium | up to 1% |
| Niobium | up to 2.38% |
| Boron | up to 0.010% |
| Nitrogen | up to 0.15% |
| Rare earth component (cerium, lanthanum or misch metal) | up to 0.6% |

To provide the high ductility and resistance to age hardening characteristic of the alloys of the invention, it is essential that cobalt be excluded or at least maintained at very low concentrations. Cobalt is a common impurity in nickel sources and some minor amounts of cobalt are commonly present in nickel alloys. It is essential, however, that the cobalt content of the alloys of the invention be no greater than approximately 0.5% by weight.

Niobium is effective not only as a partial substitute for chromium in passivating the alloy against attack by oxidizing media but is also well recognized as a carbide stabilizer. Where the alloy contains carbon, niobium is thus useful in tying the carbon up to prevent the intergranular cracking which carbon may otherwise tend to cause. Susceptibility to intergranular cracking is conventionally limited by solution annealing of carbon-containing alloys but the presence of a stabilizer such as niobium may avoid the necessity of solution heat treatment to prevent cracking in service. Additionally, niobium contributes to the hot strength of the alloy. In view of its cost, however, large proportions of niobium are preferably avoided.

Titanium and tantalum are also effective carbide stabilizers. Tantalum like niobium also contributes to the passivating effect of the chromium.

Although detrimental if present in excessive amounts, carbon is commonly present as an impurity which can be tolerated to the extent of about 0.4% by weight. A small amount of carbon may also be beneficial in enhancing the fabricability of the alloy. Where tantalum, niobium or titanium is present, the allowable carbon content may be as high as 0.07%. If the carbon content exceeds about 0.4%, however, it must be less than the sum of five times the titanium content and 10 times the tantalum plus niobium content.

Nitrogen may also be present as an impurity in the alloy, especially if it is prepared in the presence of air. A very small amount of nitrogen may actually be beneficial to the ductility and the fabricability of the alloy but amounts of nitrogen significantly higher than about 0.15% are detrimental and should be avoided.

Minor proportions of rare earth components such as cerium, lanthanum or misch metal are optionally included in the alloys of the invention. Such proportions may contribute to the fabricability of the alloys. The rare earth component should not constitute more than about 0.6% by weight of the alloy, however.

Small additions of boron contribute to the elongation of the alloy and thus its ability to be wrought. Proportions of boron significantly in excess of about 0.010% should be avoided, however, since such higher proportions of boron have a distinctly adverse effect on corrosion resistance.

Silicon can be tolerated in the alloys of the invention up to about 0.60% by weight without adverse effect on the corrosion resistance. Higher proportions of silicon are undesirable since silicon is a hard, brittle, nonmetallic ferrite-forming element which has a very adverse effect on the hardness, ductility, and fabricability of the alloy. Preferably, the silicon content is maintained at no more than about 0.45% by weight.

The alloys of the invention are prepared by conventional methods of melting and no special conditions such as controlled atmospheres, special furnace linings or special molding materials are required. Because of the relatively low strategic or critical metal content and correspondingly high iron content in these alloys, they may be formulated from relatively low cost raw materials such as scraps, ferro alloys or other commercial melting alloys. Despite their relatively high iron content, the alloys of the invention have low magnetic premeabilities consistently below 1.02.

The following examples illustrate the invention.

EXAMPLE 1

One hundred-pound heats of five different alloys were prepared in accordance with the invention. Each of these heats was air melted in a 100-pound high frequency induction furnace. The compositions of these alloys is set forth in Table I, with the balance in each instance being essentially iron.

TABLE I

| PERCENT BY WEIGHT OF ALLOYING ELEMENTS | | | | | | | | | | |
|---|---|---|---|---|---|---|---|---|---|---|
| Alloy No. | Ni | Cr | Mo | Cu | Mn | Si | C | Nb | B | Cr + .56 Nb |
| 1217 | 28.59 | 27.02 | 3.04 | 3.64 | 3.01 | .29 | .04 | .49 | — | 27.29 |
| 1218 | 30.64 | 28.85 | 3.13 | 3.68 | 3.05 | .25 | .03 | .54 | — | 29.16 |
| 1220 | 35.25 | 30.15 | 3.30 | 3.66 | 3.78 | .35 | .03 | .72 | — | 30.55 |
| 1221 | 36.72 | 28.24 | 4.10 | 3.86 | 3.55 | .33 | .04 | .06 | .005 | 28.27 |
| 1225 | 31.19 | 26.33 | 3.02 | 3.55 | 3.30 | .43 | .06 | 2.38 | — | 27.66 |

Standard physical test blocks and corrosion test bars were prepared from each heat. Using the as-cast non-heat-treated physical test blocks, the mechanical properties of each of these alloys were then measured. The results of these measurements are set forth in Table II.

TABLE II

| PHYSICAL PROPERTIES OF ALLOYS, AS CAST | | | | |
|---|---|---|---|---|
| ALLOY NO. | TENSILE STRENGTH, P.S.I. | YIELD STRENGTH, P.S.I. | TENSILE ELONGATION % | BRINELL HARDNESS NO. |
| 1217 | 55,000 | 28,000 | 26.0 | 131 |
| 1218 | 58,000 | 29,000 | 22.0 | 126 |
| 1220 | 63,380 | 34,100 | 30.0 | 131 |
| 1221 | 71,170 | 37,780 | 42.5 | 131 |
| 1225 | 53,280 | 32,560 | 20.0 | 108 |

Without heat treatment, the corrosion test bars were machined into 1½ in. diameter by ¼ in. discs, each having a ⅛ in. diameter hole in the center. Care was exercised during machining to obtain extremely smooth surfaces on the discs. Twelve to 14 discs were obtained for each alloy.

These discs were used in the comparative corrosion tests, described hereinafter, comparing the performance of the alloys of the invention with a number of alloys which either conform to certain prior art references or which are similar to the alloys of the invention but do not satisfy certain of the critical compositional limitations of the alloys of the invention. The compositions of the alloys used in these tests are set forth in Table III.

EXAMPLE 2

Using the disc samples prepared in Example 1, corrosion tests were run in 10%, 25%, 40%, 50% and 60% by weight sulfuric acid solutions at 80° C. (176° F.).

In carrying out these tests, each of the discs was cleaned with a small amount of carbon tetrachloride to remove residual machining oil and dirt and the discs were then rinsed in water and dried. Each clean, dry disc was weighed to the nearest 10,000th of a gram and then suspended in a beaker by a piece of thin platinum wire hooked through the center hole of the disc and attached to a glass rod which rested on top of the beaker. Sufficient sulfuric acid solution was then added to the beaker so that the entire sample was immersed. The temperature of the acid was thermostatically controlled at 80° C. by means of a water bath and each beaker was covered with a watch glass to minimize evaporation.

After precisely 6 hours, the sample discs were removed from the sulfuric acid solution and cleaned of corrosion products. Most samples were cleaned sufficiently with a small nylon bristle brush and tap water. Those samples on which the corrosion products were too heavy for removal with a nylon brush were cleaned with a 1:1 solution of hydrochloric acid and water. After the corrosion products had been removed, each disc was again weighed to the nearest 10,000th of a gram. The corrosion rate of each disc, in inches per year, was calculated by the following formula in accordance with ASTM specification G1-67.

TABLE III

| PERCENT BY WEIGHT ALLOYING ELEMENTS - COMPARATIVE ALLOYS | | | | | | | | | | |
|---|---|---|---|---|---|---|---|---|---|---|
| Alloy No. | Ni | Cr | Mo | Cu | Mn | Si | C | Nb | B | Cr + .56 Nb |
| 973 | 34.8 | 27.6 | 3.66 | 4.24 | 1.14 | .55 | .05 | — | .005 | 27.6 |
| 1215 | 25.43 | 24.87 | 4.30 | 3.50 | 3.74 | .25 | .04 | .43 | — | 25.11 |
| 1216 | 26.34 | 26.92 | 3.63 | 3.50 | 2.95 | .28 | .05 | .40 | — | 27.14 |
| 1219 | 30.97 | 30.10 | 3.04 | 3.53 | 3.10 | .28 | .03 | .40 | — | 30.37 |
| 1223 | 17.50 | 28.70 | 2.07 | 3.83 | 2.61 | .71 | .05 | .05 | — | 28.72 |
| 1224 | 25.38 | 25.02 | 3.53 | 6.39 | 3.26 | .57 | .05 | .61 | — | 25.36 |
| 982 | 32.35 | 17.59 | 1.83 | 3.35 | .41 | 2.14 | .04 | — | — | 17.59 |
| 986 | 33.64 | 19.02 | 2.17 | 3.44 | 1.47 | 3.23 | .04 | — | — | 19.02 |
| Carpenter 20CB3 | 35.20 | 20.05 | 2.45 | 3.55 | .50 | .72 | .04 | .51 | (.35 Ti) | 20.33 |

In the above table, Alloy Nos. 1215, 1216, 1223, 982 and 986 fall within the ranges described in Post U.S. Pat. No. 2,553,330. Alloy No. 1224 corresponds to that disclosed in Malcolm's U.S. Pat. No. 2,523,838. Carpenter 20Cb 3 is a well-known commercial alloy which corresponds to Scharfstein U.S. Pat. No. 3,168,397. Alloy Nos. 973 and 1219 are similar to the alloys of the invention, but No. 973 has a lower manganese content and No. 1219 has a nickel content which fails to exceed the chromium content by at least 1.5%.

$$R_{ipy} = 0.3937 \frac{W_o - W_f}{ATD}$$

where $R_{ipy}$ = corrosion rate in inches per year
$W_o$ = original weight of sample
$W_f$ = final weight of sample
$A$ = area of sample in square centimeters
$T$ = duration of test in years
$D$ = density of alloy in g./cc.

Results of these corrosion tests are set forth in Table IV.

TABLE IV

CORROSION RATES IN INCHES PER YEAR (I.P.Y.) PENETRATION AT 80°C. FOR VARIOUS DILUTE SULFURIC ACID-WATER SOLUTIONS

| Alloy No. | 10% | 25% | 40% | 50% | 60% |
|---|---|---|---|---|---|
| 1217 | 0.0000 | 0.0000 | 0.0003 | 0.0000 | 0.0014 |
| 1218 | 0.0000 | 0.0000 | 0.0000 | 0.0005 | 0.0143 |
| 1220 | 0.0005 | 0.0000 | 0.0008 | 0.0000 | 0.0092 |
| 1221 | 0.0000 | 0.0000 | 0.0103 | 0.0032 | 0.0081 |
| 1225 | 0.0011 | 0.0000 | 0.0132 | 0.0108 | 0.0073 |
| Carpenter 20Cb3 | 0.0041 | 0.0102 | 0.0091 | 0.0083 | 0.0102 |
| 1224 | — | — | 0.0340 | | |
| 1219 | 0.0132 | — | 0.0165 | 0.0292 | 0.00842 |

EXAMPLE 3

Comparative corrosion tests were conducted in 85%, 93% and 96% to 97% sulfuric acid solutions at 80° C. Sample discs were prepared and tested in the manner described in Example 2, except that 85%, 93% and 96% to 97% sulfuric acid solutions were utilized. The results of these tests are set forth in Table V.

TABLE V

CORROSION RATES IN INCHES PER YEAR (I.P.Y.) PENETRATION AT 80°C. IN CONCENTRATED SULFURIC ACID-WATER SOLUTIONS

| Alloy No. | 85% | 93% | 96% to 97% |
|---|---|---|---|
| 1217 | 0.0110 | 0.0116 | 0.0070 |
| 1218 | 0.0103 | 0.0092 | 0.0054 |
| 1220 | 0.0124 | 0.0000 | 0.0024 |
| 1221 | 0.0051 | 0.0049 | 0.0035 |
| 1225 | — | 0.0105 | 0.0054 |
| Carpenter 20Cb3 | 0.0232 | 0.0202 | 0.0173 |
| 1219 | — | 0.0181 | — |
| 1224 | 0.0559 | — | — |

EXAMPLE 4

Comparative corrosion tests were conducted in 80% and 85% sulfuric acid solutions at 80° C. Sample discs were prepared and tested in the manner described in Example 2, except that 80% and 85% sulfuric acid test solutions were utilized. The results of these tests are set forth in Table VI.

TABLE VI

CORROSION RATES IN INCHES PER YEAR (I.P.Y.) PENETRATION AT 80°C. FOR 80% AND 85% SULFURIC ACID-WATER SOLUTIONS

| Alloy No. | 80% | 85% |
|---|---|---|
| 1217 | 0.0111 | 0.0114 |
| 1218 | 0.0097 | 0.0103 |
| 973 | 0.0270 | 0.0270 |
| Carpenter 20Cb3 | 0.0191 | 0.0212 |

EXAMPLE 5

Comparative corrosion tests were conducted in 10%, 40% and 93% sulfuric acid solutions at 80° C. Sample discs were prepared and tested in the manner described in Example 2 using 10%, 40% and 93% sulfuric acid solutions. The results of thest tests are set forth in Table VII.

TABLE VII

CORROSION RATES IN INCHES PER YEAR (I.P.Y.) PENETRATION AT 80°C. IN DILUTE AND CONCENTRATED SULFURIC ACID-WATER SOLUTIONS

| Alloy No. | 10% | 40% | 93% |
|---|---|---|---|
| 1215 | 0.0262 | 0.0275 | 0.0246 |
| 982 | 0.0284 | 0.0392 | 0.0332 |
| 986 | 0.0421 | — | 0.0251 |

EXAMPLE 6

Comparative corrosion tests were conducted in 70% and 75% by weight sulfuric acid solutions at 80° C. Sample discs were prepared and tested in the manner described in Example 2, except that 70% and 75% by weight sulfuric acid solutions were utilized. The results of these tests are set forth in Table VIII.

TABLE VIII

CORROSION RATES IN INCHES PER YEAR (I.P.Y.) PENETRATION AT 80°C. IN DILUTE AND CONCENTRATED SULFURIC ACID-WATER SOLUTIONS

| Alloy No. | 70% | 75% |
|---|---|---|
| 1215 | 0.0639 | 0.1077 |
| 982 | 0.0448 | 0.1732 |
| 986 | — | 0.0694 |
| 1217 | 0.0243 | 0.3075 |
| 1218 | 0.0211 | 0.1937 |
| 1220 | 0.0094 | 0.0235 |
| 1221 | 0.0116 | 0.0181 |
| 1225 | 0.0068 | 0.0073 |
| Carpenter 20Cb3 | 0.051 | 0.018 |

EXAMPLE 7

Using the method described in Example 2, comparative corrosion tests were conducted in 25%, 40%, 50% and 60% sulfuric acid solutions at 80° C. The results of these tests are set forth in Table IX.

TABLE IX

CORROSION RATES IN INCHES PER YEAR (I.P.Y.) PENETRATION AT 80°C. IN VARIOUS SULFURIC ACID-WATER SOLUTIONS

| Alloy No. | 25% | 40% | 50% | 60% |
|---|---|---|---|---|
| 1216 | 0.0011 | 0.0235 | 0.0165 | 0.0193 |
| 1223 | 0.0340 | 0.0340 | 0.7476 | 1.0004 |

EXAMPLE 8

Using the method described in Example 2, comparative corrosion tests were conducted in 10%, 25%, 40% 50%, 60% and 70% sulfuric acid solutions, each containing 5% nitric acid, at 80° C. The results of these tests are set forth in Table X.

TABLE X

CORROSION RATES IN INCHES PER YEAR (I.P.Y.) PENETRATION AT 80°C. FOR VARIOUS SULFURIC ACID-WATER SOLUTIONS PLUS 5% NITRIC ACID

| Alloy No. | 10% | 25% | 40% | 50% | 60% | 70% |
|---|---|---|---|---|---|---|
| 1217 | 0.0005 | 0.0019 | 0.0019 | 0.0011 | 0.0038 | 0.0062 |
| 1218 | 0.0000 | 0.0014 | 0.0008 | 0.0005 | 0.0000 | 0.0076 |
| 1220 | 0.0032 | 0.0016 | 0.0016 | 0.0019 | 0.0032 | 0.0062 |
| 1221 | 0.0011 | 0.0000 | 0.0019 | 0.0008 | 0.0019 | 0.0032 |

TABLE X-continued

| CORROSION RATES IN INCHES PER YEAR (I.P.Y.) PENETRATION AT 80°C. FOR VARIOUS SULFURIC ACID-WATER SOLUTIONS PLUS 5% NITRIC ACID | | | | | | |
|---|---|---|---|---|---|---|
| Alloy No. | 10% | 25% | 40% | 50% | 60% | 70% |
| 1225 | 0.0046 | 0.0038 | 0.0038 | 0.0030 | 0.0046 | 0.0122 |

EXAMPLE 9

Using the method described in Example 2, comparative corrosion tests were conducted in boiling 10%, 25% and 40% sulfuric acid solutions containing 5% nitric acid. Results of these tests are set forth in Table XI.

TABLE XI

| CORROSION RATES IN INCHES PER YEAR (I.P.Y.) PENETRATION FOR VARIOUS BOILING SOLUTIONS OF SULFURIC ACID AND WATER PLUS 5% NITRIC ACID | | | |
|---|---|---|---|
| Alloy No. | 10% | 25% | 40% |
| 1217 | 0.0030 | 0.0035 | 0.0073 |
| 1218 | 0.0035 | 0.0035 | 0.0078 |
| 1220 | 0.0065 | 0.0105 | 0.0259 |
| 1221 | 0.0024 | 0.0059 | 0.0119 |
| 1225 | 0.0054 | 0.0056 | 0.0081 |

In view of the above, it will be seen that the several objects of the invention are achieved and other advantageous results attained.

As various changes could be made in the above products without departing from the scope of the invention, it is intended that all matter contained in the above description shall be interpreted as illustrative and not in a limiting sense.

What is claimed is:

1. An air-meltable, castable, workable alloy resistant to corrosion in sulfuric acid over a wide range of acid strengths consisting essentially of between about 28.59 and about 36.72% by weight nickel, between about 26.33 and about 30.15% by weight chromium, between about 3 and about 4.1% by weight molybdenum, between about 3 and about 4.5% by weight copper, between about 3 and about 4% by weight manganese, up to about 0.5% by weight cobalt, up to about 0.60% by weight silicon, up to about 0.07% by weight carbon, up to about 1% by weight tantalum, up to about 1% by weight titanium, up to about 2.38% by weight niobium, up to about 0.010% by weight boron, up to about 0.6% by weight of a rare earth component selected from the group consisting of cerium, lanthanum and misch metal, up to about 0.15% by weight nitrogen, and the balance essentially iron, provided that:

a. the sum of the chromium content and 0.56 times the niobium content is between about 27 and about 31% by weight;

b. the nickel content exceeds the chromium content by at least about 1.5%;

c. the nickel content exceeds the sum of the chromium content and 0.56 times the niobium content by at least about 1.4%; and d. where the carbon content exceeds 0.04% by weight, it is less than the sum of five times the titanium content and 10 times the niobium plus tantalum content.

2. An alloy as set forth in claim 1 wherein the chromium content is at least about 27% by weight and the copper content is no greater than about 4% by weight.

3. An alloy as set forth in claim 2 wherein the nickel content is on the order of 4% by weight greater than the sum of the chromium content and 0.56 times the niobium content.

4. An alloy as set forth in claim 3 wherein the nickel content is between about 31 and about 32% by weight and the sum of chromium content and 0.56 times the niobium content is between about 27 and about 28% by weight.

5. An alloy as set forth in claim 1 wherein the silicon content is not substantially greater than 0.45%.

* * * * *

UNITED STATES PATENT OFFICE

CERTIFICATE OF CORRECTION

PATENT NO. : 3,947,266

DATED : March 30, 1976

INVENTOR(S) : John H. Culling

It is certified that error appears in the above-identified patent and that said Letters Patent are hereby corrected as shown below:

Column 2, line 32, "4-5025%" should read -- 4-5.25% --; line 55, "contant" should read -- content --. Column 5, lines 26, 27, "of melybdenum" should read -- of molybdenum --. Column 6, line 12, "0.4%" should read -- 0.04% --; line 17, "0.4%" should read -- 0.04% --. Column 9, Table IV, the last item in the column headed "60%" reading "0.00842" should read -- 0.0842 --.

Signed and Sealed this

Twenty-first Day of September 1976

[SEAL]

*Attest:*

RUTH C. MASON
*Attesting Officer*

C. MARSHALL DANN
*Commissioner of Patents and Trademarks*